United States Patent [19]

Shikano et al.

[11] 4,392,799

[45] Jul. 12, 1983

[54] INTERNAL GEAR PUMP MOTOR

[75] Inventors: Michio Shikano; Shuzi Kitagawa, both of Toyama, Japan

[73] Assignee: Kabushiki Kaisha Fujikoshi, Toyama, Japan

[21] Appl. No.: 213,068

[22] Filed: Dec. 4, 1980

[30] Foreign Application Priority Data

Dec. 17, 1979 [JP] Japan ..... 54-162704

[51] Int. Cl.[3] ..... F04C 15/04; F04C 1/06

[52] U.S. Cl. ..... 418/169; 418/170; 418/126

[58] Field of Search ..... 418/169, 170, 126, 129

[56] References Cited

U.S. PATENT DOCUMENTS

| | | | |
|---|---|---|---|
| 260,678 | 7/1882 | Hardy | 418/129 |
| 2,983,228 | 5/1961 | Wagner | 418/169 |
| 3,525,580 | 8/1970 | Eckerle | 418/169 |
| 3,597,129 | 8/1971 | Crowther | 418/126 |
| 3,785,756 | 1/1974 | Langenderfer | 418/170 |
| 4,097,204 | 6/1978 | Palmer | 418/170 |

*Primary Examiner*—Ronald H. Lazarus
*Attorney, Agent, or Firm*—Spencer & Kaye

[57] ABSTRACT

An internal gear pump motor having a housing, a pinion and an internal gear rotatably supported in the housing and meshing with each other, and filler piece means located in a space defined between the pinion and internal gear for dividing the space into two regions providing a low pressure region and a high pressure region during operation. The filler piece means includes at least one filler piece floatingly mounted within the space and having portions capable of coming into sliding engagement with tooth crests of the pinion and internal gear respectively in a portion of the space where the distance between the tooth crests of the pinion and internal gear is reduced toward the low pressure region. A stopper pin is secured to the housing operative to engage one end of the filler piece on the side of the low pressure region for restricting the circumferential movement of the filler piece toward the low pressure region. Spring means are associated with the housing for urging the filler piece toward the low pressure region.

10 Claims, 16 Drawing Figures

INTERNAL GEAR PUMP MOTOR

BACKGROUND OF THE INVENTION

This invention relates to hydraulic pumps used in a hydraulic system, and more particularly it is concerned with improvement in an internal gear pump or motor (hereinafter referred to as an internal gear pump motor) comprising a housing, a pinion and an internal gear rotatably supported in the housing and meshing with each other, and filler piece means located in a space defined between the pinion and the internal gear for dividing the space into two regions which provide a low pressure region and a high pressure region during operation.

In one type of internal gear pump for developing high pressures known in the art capable of developing a high pressure of over 100 kg f/cm$^2$ that is commercially available, a pinion and an internal gear are adapted to make backlash-free meshing engagement with each other and a radial piston hydraulically urges the internal gear against the pinion to perform a radial pressure loading function. This type of internal gear pump has succeeded in developing a high pressure of over 300 kg f/cm$^2$. However, some disadvantages are associated with this type of internal gear pump. The need to maintain the gears in backlash-free meshing engagement entails the use of gears of high precision finishes which are expensive. In addition to the gears of high quality, the radial piston and other parts, such as rubber seal means, of high precision finishes should be used in large numbers, thereby increasing cost. The use of the rubber seal for the radial piston has raised the problem of the service life of the pump being reduced. This type of internal gear pump has not yet been put to practical use as an internal gear motor.

In another type of internal gear pump for developing high pressures known in the art that can reversibly serve as an internal gear motor, the filler piece is formed with one or a plurality of circumferential slits and the pressure oil in the high pressure region is introduced into the slits to provide a seal to the tooth crests of the pinion and the internal gear, as disclosed in Japanese Patent Application Laid-Open number 99,408/77. This construction enables a compact size to be obtained in that the radial piston, rubber seal means and other parts of the internal gear pump described hereinabove can be done without. Also, this construction enables production cost to be reduced because the aforesaid parts can be eliminated and the pinion and the internal gear do not require precision finishes and ordinary finishes can be tolerated in view of the fact that backlash need not be taken into consideration in selecting gears.

However, a split filler piece formed with slits is complex in configuration and requires a large number of parts of small size. Difficulties are encountered in producing such parts, and the filler piece becomes high in cost and short in service life.

SUMMARY OF THE INVENTION

This invention has been developed for the purpose of obviating the aforesaid disadvantages of the prior art. Accordingly, one object of the invention is to provide an internal gear pump motor which is simple in configuration and small in number of parts, compact in size, low in cost, high in durability and low in noise, capable of developing high pressures (over 100 kg f/cm$^2$), and reversibly usable as not only a hydraulic pump but also a hydraulic motor.

Another object is to provide an internal gear pump motor of the type described hereinabove which can be rotated both in the normal direction and in the reverse direction.

The aforesaid objects are accomplished according to the invention by an internal gear pump motor comprising a housing, a pinion rotatably supported in the housing, an internal gear rotatably supported in the housing and meshing with the pinion, and filler piece means located in a space defined between the pinion and the internal gear for dividing the space into two regions which provides a low pressure region and a high pressure region during operation, wherein the filler piece means includes at least one filler piece floatingly mounted in the space having portions capable of coming into sliding engagement with tooth crests of the pinion and tooth crests of the internal gear respectively in a portion of the space where the distance between the tooth crests of the pinion and the tooth crests of the internal gear is reduced toward the low pressure section, and the internal gear pump motor further comprises a stopper pin secured to the housing operative to engage one end of the filler piece on the side of the low pressure region for restricting the circumferential movement of the filler piece toward the low pressure region, and spring means associated with the housing for urging the filler piece toward the low pressure region. The internal gear pump motor according to the invention can provide the simple and inexpensive construction having parts that can be readily produced. The filler piece means according to the invention can, by advantageously utilizing the space of a crescent shape characteristic of the internal gear pump motor, be forced against the tooth crests of the pinion and the internal gear by the hydraulic pressure of the high pressure region, so that the portions of the filler piece capable of coming into sliding engagement with the tooth crests of the pinion and internal gear can serve as sealing surfaces, and at the same time, the resilience of the stopper pin can compensate for wear of the filler piece while the filler piece can perform the function of radial pressure loading. The pump according to the invention can be used as a hydraulic motor also.

Preferably, a certain clearance is provided between the filler piece and the stopper pin upon assembling of the pump motor so that slight wear may be caused on the filler piece during provisional or running-in operations performed for getting the equipment accustomed to the job, so as to enable a satisfactory seal to be provided to the tooth crests of the pinion and internal gear. Also, in place of providing the clearance, the stopper pin may be rendered movable circumferentially toward the low pressure region a distance corresponding to the clearance upon assembling of the pump motor.

Moreover, in order to compensate for the wear that might be caused on the filler piece during normal operation, the stopper pin is preferably slightly flexed or slightly movable circumferentially when the filler piece abuts thereagainst after the clearance has disappeared or after the stopper pin has moved the aforesaid distance. The spring means may include a fixed pin secured to the housing and disposed adjacent to the other end of the filler piece opposite to the one end thereof, and at least one spring mounted between the fixed pin and the filler piece to urge the latter away from the former by its biasing force.

The spring means may include a spring pin supported by the housing and engaged in an axial groove or hole formed in a portion of the filler piece in the vicinity of the other end of the filler piece oppsite to the one end thereof, to simplify the construction and facilitate the production.

In another preferred embodiment, in order that the internal gear pump may be rotatable both in the normal direction and in the reverse direction, the filler piece means may include two filler pieces disposed adjacent each other symmetrically with respect to a line connecting the center axis of the pinion with the center axis of the internal gear, two stopper pins may be disposed adjacent remote ends of the two filler pieces respectively, and the spring means may be mounted between adjacent ends of the two filler pieces to urge the two filler pieces toward the two stopper pins respectively.

Additional and other objects, features and advantages of the invention will become apparent from the description of the preferred embodiments of the invention set forth in the specification and claimed in the claims when considered in conjunction with the accompanying drawings. In all the drawings, like reference characters designate similar parts.

DETAILED DESCRIPTION OF THE DRAWINGS

Figure 4A:
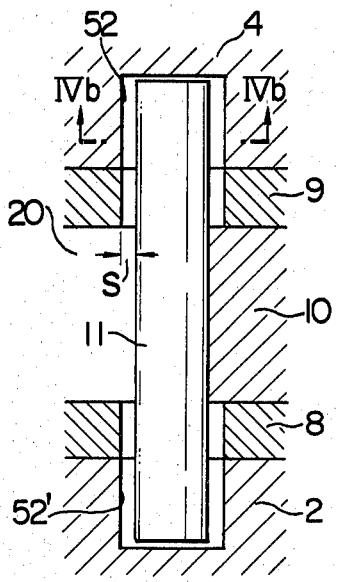
Figure 4B:
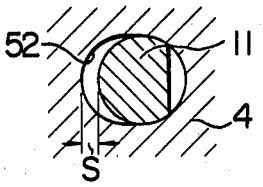

FIG. 4*a* is a fragmentary sectional view of the internal gear pump motor comprising a modification in which the stopper pin is mounted at the time of assembling for movement a certain distance circumferentially toward the low pressure region, in place of providing a clearance between the filler piece and the stopper pin;

FIG. 4*b* is a sectional view taken along the line IV—IV in FIG. 4*a;*

Figure 5A:
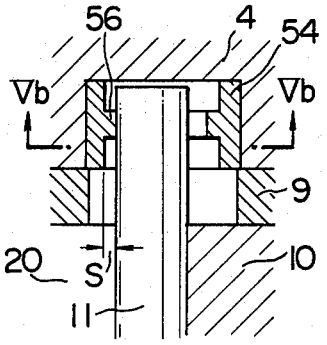

FIG. 5*a* is a fragmentary sectional view of the internal gear pump motor comprising a further modification which performs substantially similar function to the modification shown in FIG. 4*a;*

Figure 5B:
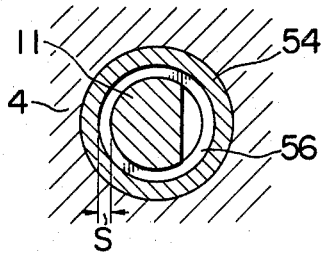

FIG. 5*b* is a sectional view taken along the line V—V in FIG. 5*a;*

Figure 6A:
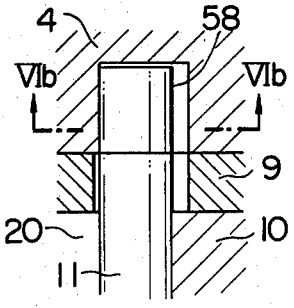
Figure 6B:
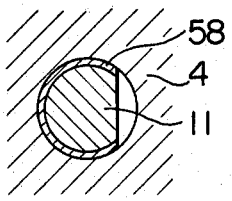

FIG. 6*a* is a fragmentary sectional view of the internal gear pump motor comprising a still further modification in which the stopper pin can be slightly moved circumferentially toward the low pressure region during normal operation without utilizing the resilience of the stopper pin;

FIG. 6*b* is a sectional view taken along the line VI—VI in FIG. 6*a;*

Figure 7A:
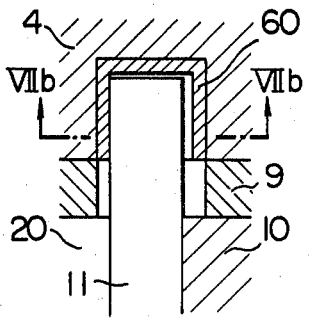

FIG. 7*a* is a fragmentary sectional view of the internal gear pump motor comprising a still further modification which performs substantially similar function to the modification shown in FIG. 6*a;*

Figure 7B:
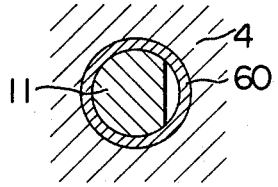

FIG. 7*b* is a sectional view taken along the line VII—VII in FIG. 7*a;*

Figure 2:
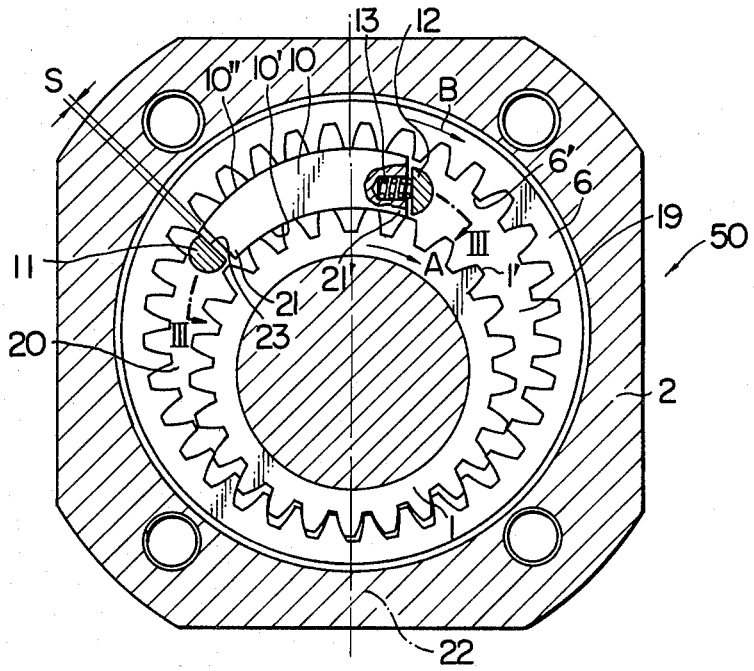
FIG. 2 is a sectional view, on an enlarged scale, of the internal gear pump motor taken along the line II—II in FIG. 1.
Figure 9:
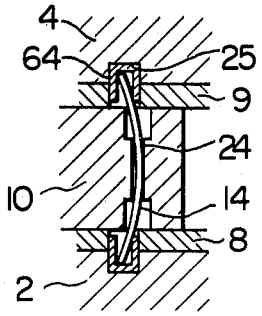
Figure 12:
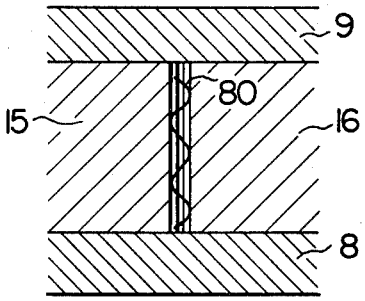
Figure 8:
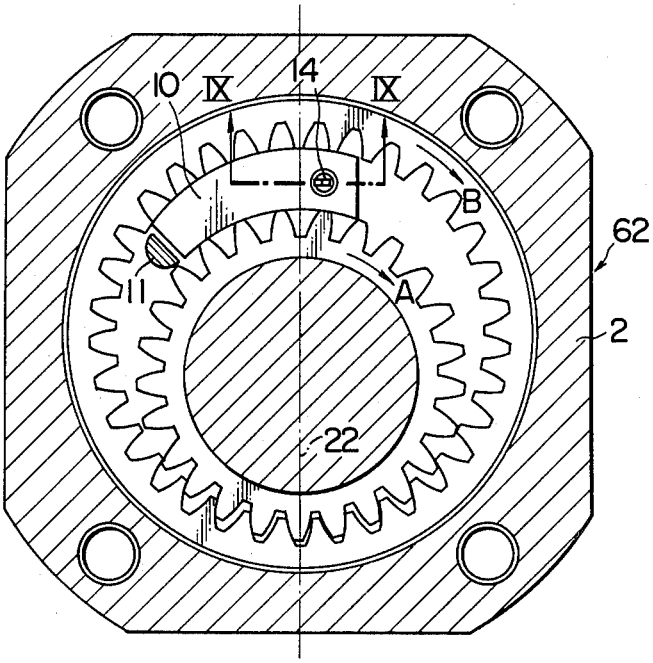
Figure 10:
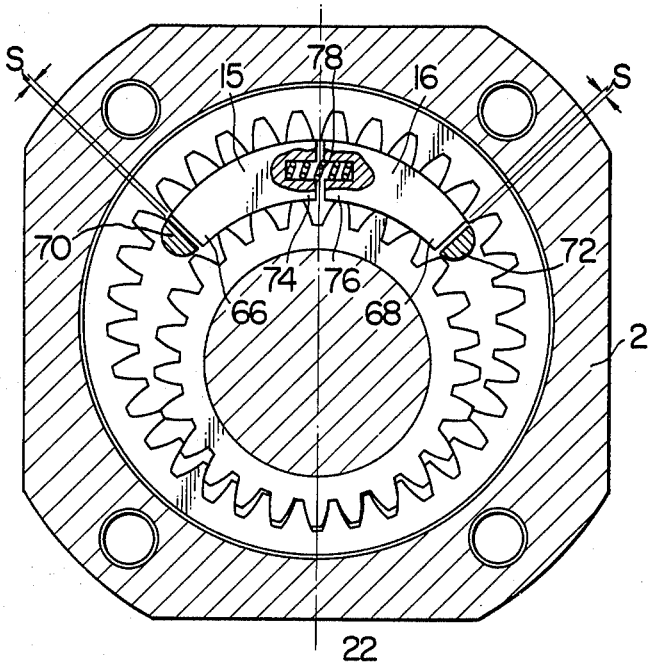
Figure 11:
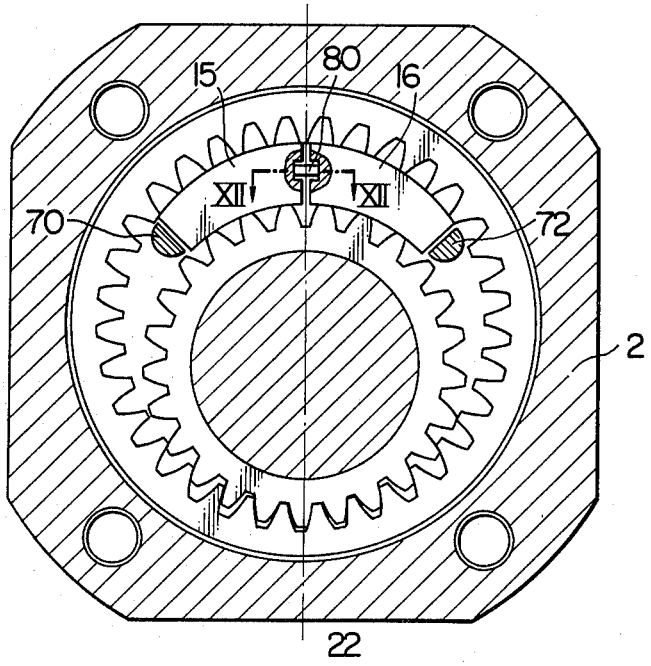

FIG. 8 is a sectional view similar to FIG. 2 showing the internal gear pump motor comprising another embodiment of the invention;

FIG. 9 is a sectional view taken along the line IX—IX in FIG. 8;

FIG. 10 is a sectional view similar to FIG. 2 showing the internal gear pump motor comprising still another embodiment of the invention which can be rotated both in the normal direction and in the reverse direction;

FIG. 11 is a sectional view similar to FIG. 10 but showing a modification of the embodiment shown in FIG. 10 capable of rotating both in the normal direction and in the reverse direction; and FIG. 12 is a sectional view taken along the line XII—XII in FIG. 11.

DESCRIPTION OF THE PREFERRED EMBODIMENTS

Figure 1:
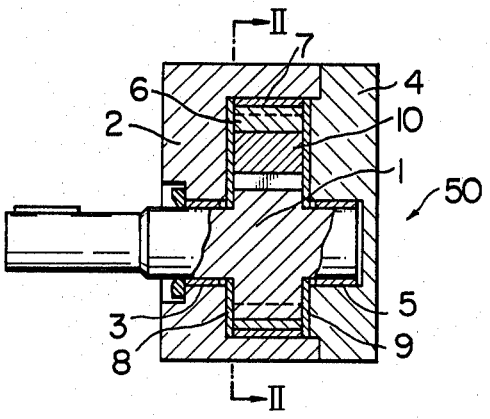
FIG. 1 is a vertical longitudinal sectional view of the internal gear pump motor comprising one embodiment of the invention.
Figure 3:
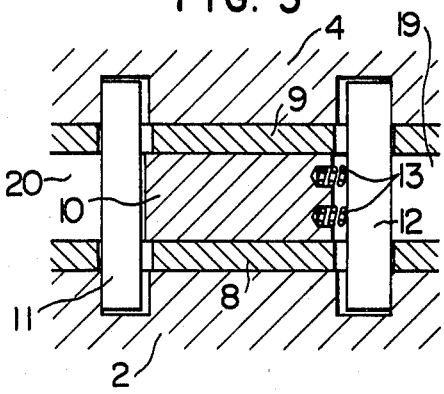
FIG. 3 is a fragmentary sectional view, on an enlarged scale, of the internal gear pump motor taken along the line III—III in FIG. 2.

Referring to FIG. 1, an internal gear pump motor comprising a preferred embodiment of the invention is generally designated by the reference numeral 50, and the internal gear pump motor 50 comprises a housing including a body 2 and a cover 4. The term 'housing' is used to represent an entirety further including bearings 3, 5 and 7 and axial plates 8 and 9. A pinion 1 is rotatably supported by the bearings 3 and 5 fitted to the body 2 and cover 4 respectively. Maintained in meshing engagement with the pinion 1 is an internal gear 6 which is rotatably supported by the bearing 7 fitted to the body 2. The pinion 1 and the internal gear 6 are assembled to mesh with each other with a backlash, in order that the need to give precision finishes to the gears may be eliminated and the basic frequency of the noise produced by the internal gear pump motor may be lowered. To enable the internal gear pump motor to develop high pressures, a known axial pressure wear compensating mechanism, not shown, may be provided if necessary, in addition to the axial plates 8 and 9, by introducing the high pressure fluid of the internal gear pump motor between the axial plate 8 and body 2 and the axial plate 9 and cover 4.

Referring to FIG. 2 which is a sectional view taken along the line II—II in FIG. 1, the pinion 1 rotates in the direction of an arrow A (clockwise in the figure) and the internal gear 6 meshing with the pinion 1 also rotates in the same direction or in the direction of an arrow B. A space is defined between the pinion 1 and the internal gear 6 by teeth of the pinion 1 and internal gear 6 and the axial plates 8 and 9 (See FIG. 1). In the space, a filler piece 10 is floatingly mounted for dividing the space into two regions which provide a high pressure region 19 and a low pressure region 20 during operation. The filler piece 10 is one in number in this embodiment and includes two portions 10' and 10'' capable of coming into sliding engagement with tooth crests 1' of the pinion 1 and tooth crests 6' of the internal gear 6 respectively in a portion of the space where the distance between the tooth crests 1' of the pinion 1 and the tooth crests 6' of the internal gear 6 is reduced toward the low pressure region 20. A stopper pin 11 is secured to the body 2 and cover 4 to engage one end 21 of the filler piece 10 on the side of the low pressure region 20 for restricting the circumferential movement of the filler piece 10 toward the low pressure region 20 or counterclockwise in the figure. Preferably, the stopper pin 11 is generally fitted in holes extending through the axial plates 8 and 9 into the body 2 and the cover 4 respectively. Thus the filler piece 10 is designed in a manner to be able to withstand the hydraulic pressure that would be produced in the high pressure region 19 and applied to the filler piece 10 when high pressure is produced within the housing. The term "secured to the housing" used herein includes securing directly to the housing or indirectly thereto through the axial plates 8 and 9 against relative movement with respect to the housing. At least one spring (two in number in this embodiment) 13 urging the filler piece 10 toward the low pressure region 20 or against the stopper pin 11 is fitted in a recess formed in the other end 21' of the filler piece 10 on the side of the high pressure region 19 and engages a fixed pin 12 secured to the housing adjacent to the other end 21' of the filler piece 10, so as to urge the filler piece 10 away from the fixed pin 12. When the pinion 1 and the internal gear 6 meshing with each other rotate in the direction of the arrows A and B at no load, the filler piece 10 would be pulled by the tooth crests 1' and 6' and move into the high pressure region 19, and a gap would be formed between the filler piece 10 and the tooth crests 1' and 6', if there were no means provided for preventing the movement of the filler piece 10 toward the high pressure region 19. When this phenomenon occurs, it would be impossible to raise the pressure developed by the internal gear pump motor. The spring 13 is intended to avoid the occurrence of this phenomenon by biasing the filler piece 10 beforehand.

The operation of the internal gear pump motor of the aforesaid construction will be described. When functioning as a pump, the pinion 1 is rotated in the direction of the arrow A by a motor, not shown, and a fluid introduced into the low pressure region 20 through a passage, not shown, is delivered into the high pressure region 19 where the pressure of the fluid rises. The fluid under high pressure is then discharged through a passage, not shown. The filler piece 10 is urged by the hydraulic pressure of the fluid in the high pressure region 19 against the tooth crests 1' of the pinion 1 and the tooth crests 6' of the internal gear 6 to be supported thereby. Thus the portions 10' and 10'' of the filler piece 10 function as sealing surfaces with respect to the tooth crests 1' and 6' respectively to provide a satisfactory seal therebetween, and at the same time the resilience of the stopper pin 11 can compensate for the wear that might be caused on the portions 10' and 10'' of the filler piece 10. At this time, the filler piece 10 urges the pinion 1 against the portion of the internal gear 6 which is in meshing engagement with the pinion 1, so that the filler piece 10 can perform the function of radial pressure loading.

When functioning as a hydraulic motor, a fluid under high pressure is introduced into the high pressure region 20 through a passage, not shown, and the pinion 1 and internal gear 6 are rotated in a direction opposite to the direction of the arrows A and B (counterclockwise in FIG. 2). In this case also, the filler piece 10 provides a satisfactory seal between the tooth crests 1' and 6' of the pinion 1 and internal gear 6 respectively, the wear that might be caused on the portions 10' and 10'' of the filler piece 10 can be compensated for by the resilience of the stopper pin 11, and the filler piece 10 can perform the function of radial pressure loading.

In the aforesaid construction, the filler piece 10, stopper pin 11, fixed pin 12 and spring 13 are simple in shape and compact in size. Thus the construction is simple and easy to fabricate, and low in cost. As aforesaid, the filler piece 10 is urged against the tooth crests 1' and 6' of the pinion 1 and internal gear 6 respectively by the hydraulic pressure of the fluid in the high pressure region 19 by utilizing the space of the crecent shape characteristic of the internal gear pump motor. Thus the portions 10' and 10'' of the filler piece 10 function as sealing surfaces, the stopper pin 11 can compensate for the wear that might be caused on the filler piece 10 by its resilience, and the filler piece 10 can perform the function of radial pressure loading. Because of these features, the internal gear pump motor can function under high pressure, and it can function as a hydraulic motor. Since a backlash is tolerated in the meshing engagement between the pinion 1 and the internal gear 6, the gears need not be subjected to precision finishes, and the basic frequency for noise is low and the pump motor produces less noise than those of the prior art. The need to use a radial piston is eliminated.

Preferably, a certain clearance S is provided between the filler piece 10 and the stopper pin 11 at the time of initial assembling as shown in FIG. 2, so that slight wear will be caused on the filler piece 10 during provisional or running-in operations performed to get the equipment accustomed to the job, so as to enable the internal gear pump motor to accommodate higher pressures by providing a perfect seal between the portions 10' and 10'' of the filler piece 10 and the tooth crests 1' and 6' of the pinion 1 and internal gear 6 respectively. In this case, during running-in operations, the hydraulic pressure produced in the high pressure region 19 urges the filler piece 10 to move toward the stopper pin 11, and the portions 10' and 10'' of the filler piece 10 are worn away until the clearance S becomes zero and the filler piece 10 abuts against the stopper pin 11, so that the inner and outer diameters of the portions 10' and 10'' of the filler piece 10 are brought into substantially complete agreement with the outer and inner diameters of the tooth crests 1' and 6' of the pinion 1 and internal gear 6 respectively. Thus a satisfactory seal can be provided between the filler piece 10 and the pinion 1 and internal gear 6, and the internal gear pump motor is capable of accommodating higher pressures while its service life is prolonged and the noise produced thereby is reduced.

Alternatively, in place of providing the clearance S, the stopper pin 11 may be made movable a distance corresponding to the clearance S circumferentially toward the low pressure region 20 at the time of initial assembling, although this involves a slight increase in cost. Such alternative constructions are shown in FIGS. 4*a*, 4*b*, 5*a* and 5*b*. The construction shown in FIGS. 4*a* and 4*b* includes holes 52 and 52' formed in the cover 4 and axial plate 9 and the body 2 and axial plate 8 respectively to receive opposed end portions of the stopper pin 11 therein. The holes 52 and 52' have a slightly elongated cross-section, and the opposed end portions of the stopper pin 11 are fitted in the holes to engage with opposed portions thereof radially smaller in cross-section so that a clearance S is formed between one of opposed portions of the hole 52 and 52' radially larger in cross-section and the stopper pin 11. When the stopper pin 11 is urged toward the low pressure region 20 by the filler piece 10 receiving the hydraulic pressure in the high pressure region 19, the stopper pin 11 is moved in the holes 52 and 52' a distance corresponding to the clearance S. The holes 52 and 52' with such a cross-section may be formed only in the body 2 and the cover 4 while loose circular holes may be formed in the axial plates 8 and 9.

In the alternative construction shown in FIGS. 5*a* and 5*b*, an adjusting ring 54 formed of a deformable material, such as a copper alloy, is fitted in each of the holes formed in the body 2 and cover 4 respectively for supporting the stopper pin 11 therein. The adjusting ring 54 is formed on its inner wall surface with an annular projection 56 of a height S against which the stopper pin 11 abuts. When the filler piece 10 receiving the hydraulic pressure in the high pressure region 19 urges the stopper pin 11 toward the low pressure region 20, the projection 56 of the adjusting ring 54 is depressed to allow the stopper pin 11 to move a distance corresponding to the height S of the projection 56.

In the embodiment shown in FIG. 2, when the clearance S becomes zero following the completion of running-in operations, the filler piece 10 receiving the hydraulic pressure of the fluid in the high pressure region 19 is borne by the stopper pin 11 and by the tooth crests 1' of the pinion 1 and the tooth crests 6' of the internal gear 6. However, the wear caused on the portions 10' and 10'' of the filler piece 10 in engagement with the tooth crests 1' and 6' increases the force with which the filler piece 10 abuts against the stopper pin 11. Therefore, by selecting a material of suitable resilience for the stopper pin 11, it is possible to cause the stopper pin 11 to resiliently yield or flex to allow the filler piece 10 to further move toward the low pressure region 20. This enables the perfect seal provided between the filler piece 10 and the tooth crests 1' of the pinion 1 and the tooth crests 6' of the internal gear 6 to remain unaltered, so that the internal gear pump motor can have a prolonged service life. Alternatively, the stopper pin 11 may be made depressible at its abutting surface 23 or movable circumferentially toward the low pressure region 20. Such alternative constructions are shown in FIGS. *6a, 6b* and *7a, 7b*.

In the construction shown in FIGS. *6a* and *6b*, each end portion of the stopper pin 11 is coated with a deformable material, such as a copper alloy, to form the stopper pin 11 with a copper alloy layer 58 of a suitable thickness. The stopper pin 11 will be supported through the copper alloy layers 58 in the holes formed in the body 2 and cover 4 so that the layers 58 may be depressed as the filler piece 10 initiates to strongly abut thereagainst.

The construction shown in FIGS. *7a* and *7b* includes a sleeve 60 fitted in each of the holes formed in the body 2 and cover 4. The sleeve 60 is formed of a deformable material, such as a copper alloy and has a suitable thickness. The stopper pin 11 can be supported by the sleeves 60 at opposite end portions thereof so that the sleeves 60 may be depressed as the filler piece 10 initiates to strongly abut thereagainst.

Although not shown, a deformable material, such as a copper alloy, may be brazed to the abutting surface 23 of the stopper pin 11 against which the filler piece 10 abuts so that the abutting surface 23 may be slightly depressed as the filler piece 10 initiates to strongly abut thereagainst.

FIGS. 8 and 9 show an internal gear pump motor 62 comprising another embodiment of the invention. In this embodiment, to facilitate fabrication, a spring pin 14 is used which is supported at opposite ends in holes 25 formed in the housing either directly or through supporters 64 and received in an axial hole 24 formed in a portion of the filler piece 10 in the vicinity of the other end thereof opposite to the one end thereof which abuts against the stopper pin 11, so as to urge the filler piece 10 toward the low pressure section 20. The axial hole 24 may be replaced by a groove.

In the embodiments shown in FIGS. 2 and 8, the pinion 1 rotates in the direction of the arrow A when the internal pump motor functions as a pump, and in a direction opposite to the direction of the arrow A when it functions as a hydraulic motor. However, in a type of internal gear pump which requires the pinion 1 to rotate in a direction opposite to the direction described hereinabove, the filler piece 10, stopper pin 11, and spring 13 or spring pin 14 are arranged on the opposite side symmetrically with respect to a line 22 connecting the center axis of the pinion 1 to the center axis of the internal gear 6, that is, the major portion of the filler piece 10 and the stopper pin 11 are positioned on the right side of the line 22 and the spring 13 or spring pin 14 are located on the left side thereof in the figures.

FIGS. 10 and 11 show other embodiments of the invention in which the internal gear pump motor can rotate both in the normal direction and in the reverse direction.

In the embodiment shown in FIG. 10, two filler pieces 15 and 16 are located adjacent each other symmetrically with respect to the line 22 connecting the center axis of the pinion 1 to the center axis of the internal gear 6, and two stopper pins 70 and 72 are located adjacent remote ends 66 and 68 of the filler pieces 15 and 16 respectively. At least one spring 78 is mounted between adjacent ends 74 and 76 of the two filler pieces 15 and 16 for urging the two filler pieces 15 and 16 toward the stopper pins 70 and 72 respectively. The spring 78 is inserted in aligned holes formed in the adjacent ends 74 and 76 of the filler pieces 15 and 16 respectively.

The embodiment shown in FIG. 11 comprises a corrugated spring 80 for urging the two filler pieces 15 and 16 toward the stopper pins 70 and 72 respectively. The corrugated spring 80 is inserted in aligned grooves formed in the adjacent ends 74 and 76 of the filler pieces 15 and 16 respectively, as shown in FIG. 12.

The construction shown in FIG. 10 is slightly more expensive than the construction shown in FIG. 11, but offers the advantages that the spring has a low spring constant so that the performance can be stabilized.

It will be apparent that the embodiments of the internal gear pump in conformity with the invention shown in FIGS. 10 and 11 are capable of rotating both in the normal direction and in the reverse direction.

While the invention has been described by referring to the preferred embodiments thereof shown and described herein for accomplishing the objects set forth in the summary of the invention, it will be understood that the invention is not limited to the specific forms of the embodiments shown and described and that many changes and modifications may be made therein without departing from the scope of the invention which is defined in the claims.

What is claimed is:

1. An internal gear pump motor comprising: a housing; a pinion rotatably supported in said housing; an internal gear rotatably supported in said housing and meshing with said pinion in said housing; and filler piece means located in a space defined between said pinion and said internal gear for dividing the space into two regions which provide a low pressure region and a high pressure region during operation; wherein:

said filler piece means includes at least one filler piece floatingly mounted within said space and having portions capable of coming into sliding engagement with tooth crests of said pinion and tooth crests of said internal gear respectively in a portion of said space where the distance between the tooth crests of the pinion and the tooth crests of the internal gear is reduced toward said low pressure region; and said internal gear pump motor further comprises a stopper pin secured to said housing operative to engage one end of said filler piece on the side of said low pressure region for restricting the circumferential movement of the filler piece toward the low pressure region, and spring means associated with said housing for urging said filler piece toward said low pressure region.

2. An internal gear pump motor as set forth in claim 1, wherein a certain clearance is defined between said filler piece and said stopper pin upon assembling of the pump motor.

3. An internal gear pump motor as set forth in claim 1, wherein said stopper pin is mounted in a manner to be movable a certain distance circumferentially toward said low pressure region upon assembling of the pump motor.

4. An internal gear pump motor as set forth in claim 2 or 3, wherein said stopper pin can be slightly flexed or can slightly move circumferentially when said filler piece abuts thereagainst after said clearance between the filler piece and the stopper pin has disappeared or the stopper pin has moved the aforesaid distance.

5. An internal gear pump motor as set forth in claim 1, 2 or 3, wherein said spring means includes a fixed pin secured to said housing adjacent to the other end of said filler piece opposite to said one end thereof, and at least one spring mounted between said fixed pin and said filler piece to urge the filler piece away from the fixed pin.

6. An internal gear pump motor as set forth in claim 1, 2 or 3, wherein said spring means includes a spring pin supported by said housing and received in an axial groove or hole formed in a portion of said filler piece in the vicinity of the other end of the filler piece opposite to said one end thereof.

7. An internal gear pump motor as set forth in claim 1, 2 or 3, wherein said filler piece means includes two filler pieces located adjacent each other symmetrically with respect to a line connecting the center axis of said pinion to the center axis of said internal gear, two stopper pins are disposed adjacent remote ends of the two filler pieces respectively, and spring means is mounted between adjacent ends of said two filler pieces for urging the two filler pieces toward said two stopper pins respectively.

8. An internal gear pump motor as set forth in claim 4, wherein said spring means includes a fixed pin secured to said housing adjacent to the other end of said filler piece opposite to said one end thereof, and at least one spring mounted between said fixed pin and said filler piece to urge the filler piece away from the fixed pin.

9. An internal gear pump motor as set forth in claim 4, wherein said spring means includes a spring pin supported by said housing and received in an axial groove or hole formed in a portion of said filler piece in the vicinity of the other end of the filler piece opposite to said one end thereof.

10. An internal gear pump motor as set forth in claim 4, wherein said filler piece means includes two filler pieces located adjacent each other symmetrically with respect to a line connecting the center axis of said pinion to the center axis of said internal gear, two stopper pins are disposed adjacent remote ends of the two filler pieces respectively, and spring means is mounted between adjacent ends of said two filler pieces for urging the two filler pieces toward said two stopper pins respectively.

* * * * *